United States Patent [19]

Bonniau et al.

[11] Patent Number: 4,660,012

[45] Date of Patent: Apr. 21, 1987

[54] POLARIZED ELECTROMAGNETIC RELAY WITH MAGNETIC LATCHING FOR AN ELECTRIC CIRCUIT BREAKER TRIP RELEASE

[75] Inventors: Michel Bonniau, Lux; Pierre Schueller, Grenoble, both of France

[73] Assignee: Merlin Gerin, Grenoble, France France

[21] Appl. No.: 794,465

[22] Filed: Nov. 4, 1985

[30] Foreign Application Priority Data

Nov. 22, 1984 [FR] France ..... 8418009

[51] Int. Cl.[4] ..... H01F 7/08

[52] U.S. Cl. ..... 335/234; 335/179; 335/180

[58] Field of Search ..... 335/174, 179, 180, 229, 335/230, 234, 255, 262

[56] References Cited

U.S. PATENT DOCUMENTS

| | | | |
|---|---|---|---|
| 3,755,766 | 8/1973 | Read | 335/234 X |
| 3,792,390 | 2/1974 | Boyd | 335/230 |
| 3,886,507 | 5/1975 | Johnston et al. | 335/234 |
| 4,072,918 | 2/1978 | Read | 335/174 X |
| 4,462,013 | 7/1984 | Ueda et al. | 335/229 |

FOREIGN PATENT DOCUMENTS

| | | | |
|---|---|---|---|
| 0107167 | 5/1984 | European Pat. Off. | 335/234 |
| 2339246 | 8/1977 | France | 335/234 |
| 2412160 | 7/1979 | France | 335/234 |

*Primary Examiner*—George Harris

*Attorney, Agent, or Firm*—Parkhurst & Oliff

[57] ABSTRACT

The invention relates to a polarized electromagnetic relay with magnetic latching and sliding armature.

The magnetic circuit comprises a tubular frame enclosed by two flanges (22, 24), a permanent magnet (14) with axial magnetization fitted between one (22) of the flanges and a flux-diverter (26), and a cylindrical trip coil (30) mounted on a bushing inside the frame (20). The other flange (24) is fitted with a tubular sleeve (46) made of ferromagnetic material coaxially surrounding a part of the moving armature (16) with a uniform radial air gap (jl) interposed. The axial overlapping distance (L) of the armature (16) by the sleeve (46) in the latched position of the relay (10) is greater than the thickness (11) of the flange (24) and/or than that of the frame (20).

10 Claims, 3 Drawing Figures

POLARIZED ELECTROMAGNETIC RELAY WITH MAGNETIC LATCHING FOR AN ELECTRIC CIRCUIT BREAKER TRIP RELEASE

BACKGROUND OF THE INVENTION

The invention relates to a polarized electromagnetic relay with magnetic latching, notably of a trip device for an electric circuit breaker, comprising:

a fixed magnetic circuit made of ferromagnetic material comprising a tubular frame affixed at its opposite ends to a first and a second parallel flange, extending perpendicularly to the longitudinal axis of the frame, an annular permanent magnet with axial magnetization whose coplanar front surfaces of opposed polarities come into contact respectively with the internal wall of the first flange and one of the faces of a magnetic flux-diverter, a moving armature mounted to slide axially according to the direction of the longitudinal axis between a latched position and a released position, said armature being urged into the released position by a return spring and in the latched position being pressed against the flux-diverter by the magnetic attraction force of the permanent magnet which is of greater intensity than the bias of the return spring, an actuating member associated with the armature and passing axially through an opening in the second flange, the armature and actuating member assembly forming the moving assembly of the relay, a first axial air gap corresponding to the gap between the flux-diverter and the moving armature, a trip coil mounted coaxially on an insulating bushing inside the frame surrounding the moving armature and extending axially between the flux-diverter and the second flange, excitation of said coil causing in the magnetic circuit a magnetic flux which opposes the polarization flux of the permanent magnet in the first air gap, so as to release the armature and enable it to move from the latched position to the released position by means of the return spring.

According to a prior art device of the kind mentioned, the return spring of the moving armature is fitted outside the magnetic circuit, and the axial length of the coil is smaller than that of the permanent magnet. The high reluctance of the magnetic circuit in the latching position of the armature requires a high tripping flux which increases the coil tripping energy. The use of a relay of this kind in an own current trip release is dependent on a large trip signal obtained either by amplification or by larger current sensors.

The object of the invention is to overcome these disadvantages and to provide a trip relay having high sensitivity and reduced dimensions.

SUMMARY OF THE INVENTION

The relay according to the invention is characterized by the fact that the second flange of the magnetic circuit is fitted with a fixed internal sleeve of tubular shape made of ferromagnetic material, extending partially in an annular space located coaxially between the bushing and the moving armature, the latter being separated from said sleeve by a second radial air gap which remains uniform during the translation movement of the armature, and that the axial overlap distance of the armature by the sleeve in the latched position of the relay is greater than the thickness of the second flange and/or than that of the frame.

The presence of the ferromagnetic sleeve around the armature reduces the reluctance of the magnetic circuit leading to a decrease of the coil trip flux. This results in increased sensitivity of the relay and decreased tripping energy.

According to an embodiment of the invention, guiding means of the moving assembly in axial translation determine a predetermined radial clearance with the moving armature, the thickness of said clearance being smaller than that of the second radial air gap between the sleeve and the armature.

This difference in size between the guiding clearance and the second radial air gap is indispensable to preserve the uniformity of said air gap during translation of the moving armature. The armature guiding means can comprise either an annular ledge cast with the coil insulating bushing, or a non-magnetic bush, notably made of brass, axially interposed between the sleeve and the flux-diverter.

According to one feature of the invention, the flux-diverter can be saturated, and extends radially according to a direction parallel to the first flange to come into contact with the internal lateral surface of the frame, the thickness of said flux-diverter in its narrowest part being smaller than the thickness of the permanent magnet and/or than that of the frame.

The return spring is of the compression type and the armature has an axial hole closed at one end to house a part of said spring, the latter passing through the annular flux-diverter and permanent magnet, its opposite end bearing on a central boss of the first flange.

The external radius of the annular permanent magnet is greater than its thickness, the latter corresponding to the axial distance separating the first flange and the flux-diverter. The axial length taken up by the coil is at least greater than half the total length of the relay.

The dimensions of the magnet, the flux-diverter and the coil can naturally be modified depending on the tripping characteristics.

Other advantages and characteristics of the invention will become more clearly apparent from the description which follows of two embodiments of the invention, given as examples only and represented in the accompanying drawings, in which:

DESCRIPTION OF A PREFERRED EMBODIMENT

Figure 2:
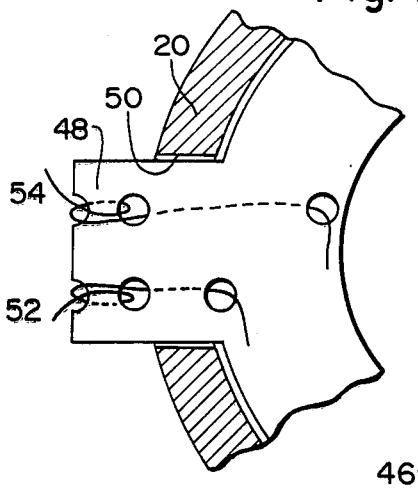
FIG. 2 is a partial sectional view along the line II—II of FIG. 1.
Figure 1:
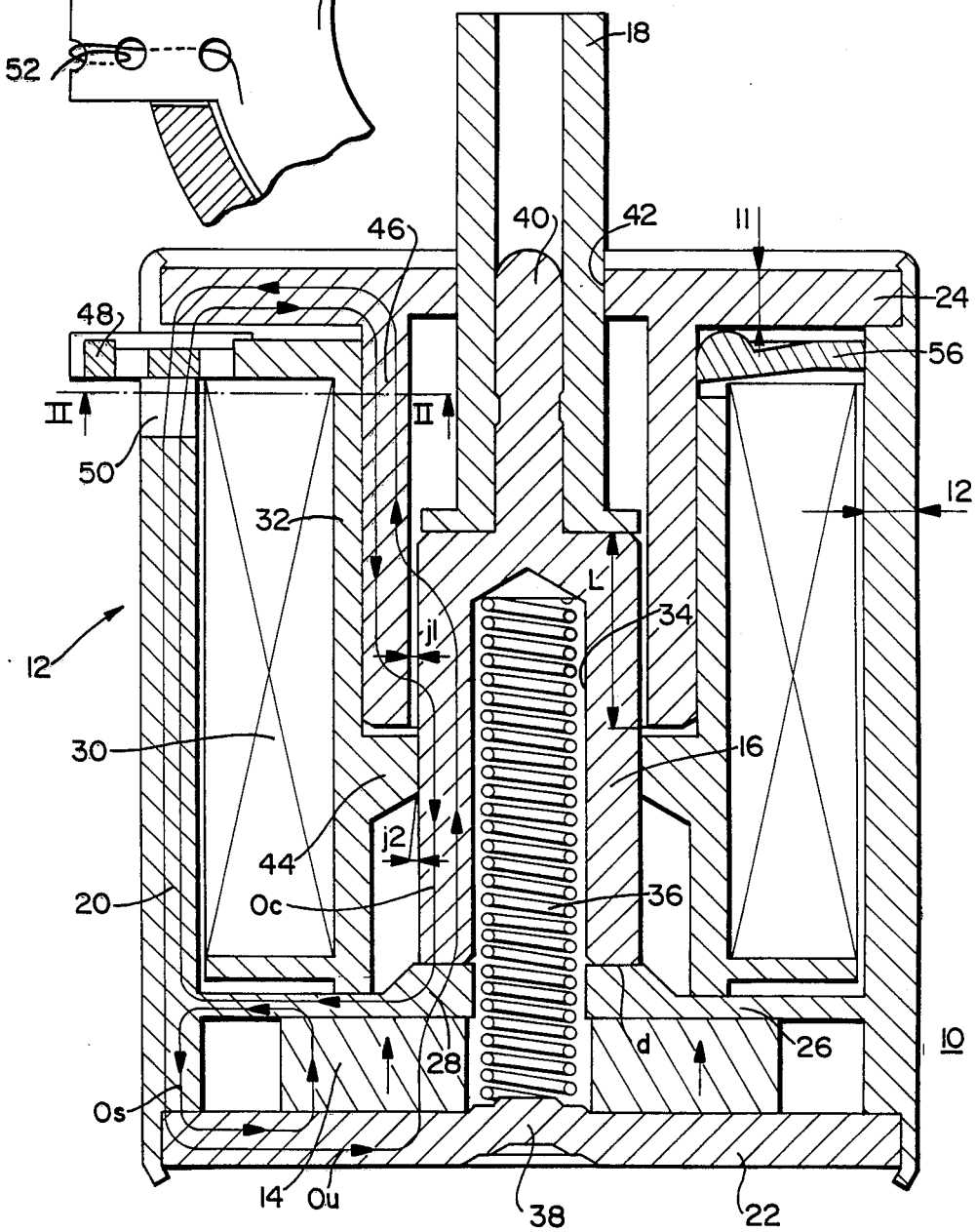
FIG. 1 is an axial sectional view of a relay according to the invention, represented in the reset position.

Referring to FIGS. 1 and 2, a high sensitivity electromagnetic trip relay 10 for an electric circuit breaker comprises a fixed magnetic circuit 12 polarized by a permanent magnet 14 and cooperating with a sliding armature 16 associated with an actuating member 18. The magnetic circuit 12 is formed by a ferromagnetic frame 20 in the shape of a cylindrical shell closed at its opposing ends by a pair of disk-shaped flanges 22, 24. The axial magnetization permanent magnet 14 is housed inside the frame 20 and presents an annular shape with coplanar front surfaces of opposed polarities coming into contact respectively with the internal wall of the first flange 22 and one of the parallel faces of a magnetic flux-diverter 26.

The two flanges 22, 24 and the flux-diverter 26 are made of ferromagnetic material and the external radius of the permanent magnet 14 is greater than its thickness corresponding to the axial distance separating the first flange 22 from the flux-diverter 26. The latter extends radially towards the internal lateral surface of the frame 20 and has an annular extension 28 cooperating with the cylindrical-shaped moving armature 16.

A trip coil 30 is mounted coaxially in a cylindrical bushing 32 made of insulating material, inside the frame 20 extending axially between the flux-diverter 26 and the second flange 24. The moving armature 16 is formed by a plunger core mounted to slide axially inside the cylindrical bushing 32 alternately between a first latched position and a second tripping position. The core of the armature 16 has an axial hole 34 closed at one end to house a return spring 36 of the compression type, whose opposite end takes its bearing on a central boss 38 of the first flange 22. The spring 36 passes axially through the permanent magnet 14 and the flux-diverter 26, and urges the moving armature 16 in the direction of the second tripping position. During its release movement in the tripping position direction, the spring 36 is guided in translation by the cylindrical wall of the hole 34.

The actuating member 18 is fitted with a tubular striker or pusher fitted over an axial extension 40 of the armature 16 and designed to cooperate with a lock (not represented) of a mechanism, respectively when tripping takes place by excitation of the coil 30, and when the relay 10 is reset causing the armature 16 to return to the first latched position. The actuating member 18 is made of plastic insulating material and passes axially through a circular opening 42 in the second flange 24.

The armature 16 moves in a first variable axial air gap (d), which is nil when the armature is in abutment against the extension 28 of the flux-diverter 26, and maximum when the armature 16 is in the trip position.

The armature 16 and the actuating member 18 comprise the moving assembly cooperating with guiding means in axial translation made up on the one hand by an annular ledge 44, arranged around the armature 16, said ledge 44 being cast with the fixed bushing 32 supporting the coil 30, and on the other hand by the circular opening in the flange 24 acting as a bearing for the striker 18.

The second flange 24 is fitted with a tubular internal sleeve made of ferromagnetic material, extending up to the ledge 44 in an annular space bounded radially by the cylindrical bushing 32 and the armature 16. The sleeve 46 surrounds the armature 16 coaxially with a second predetermined radial air gap (j1) interposed, the thickness of which is greater than the guiding clearance (j2) provided between the ledge 44 and the armature 16. This difference in size between the air gap j1 and the clearance j2 is indispensable to preserve the uniformity of the radial air gap j1 when translation of the moving assembly takes place according to the axial direction, and to avoid any magnetic attraction against the sleeve 46 liable to prevent the armature 16 from sliding freely.

A radial lug 48 of the insulating bushing 32 protrudes through a notch 50 in the frame 20 serves the purpose both of preventing rotation of the coil 30 and of supporting the wires 52, 54 connected to the coil 30. A curved-shaped flexible strip 56 is interposed between one of the front faces of the coil 30 and the second flange 24 to automatically take up any axial play when the various parts which constitute the relay 10 are assembled. The flexible strip 56 is cast directly with the insulating bushing 32 of the coil 30.

The insulating actuating member 18 can be of any shape depending on the circuit breaker lock structure, and/or of the circuit breaker rating. The thickness of the flux-diverter 26 at its narrowest part situated around the extension 28 is smaller than the thickness (12) of the frame 20 and than that of the magnet 14. The axial length of the coil 30 is very large in relation to the thickness of the permanent magnet 14. The spacing of the second radial air gap (j1) is smaller than the thickness (11) of the second flange 24.

Operation of the polarized trip relay 10 according to FIGS. 1 and 2 is as follows:

In the tripped position of the moving armature 16, the coil 30 is not supplied, and the whole of the flux generated by the permanent magnet 14 flows through the reduced part of the flux-diverter 26, a portion of the frame 20, coaxially surrounding the magnet 14, and the first flange 22. The flux-diverter 26 is saturated, and no flux flows through the rest of the magnetic circuit 12.

In the course of the resetting operation of the relay 10, the moving armature 16 moves in translation in a first axial air gap (d), and comes into abutment against the polar surface of the extension 28 of the flux-diverter 26. The spring 36 is then in the compressed state. The flux of the permanent magnet 14 splits into two elementary fluxes $\phi_S$ and $\phi_U$ (see FIG. 1), the first flux $\phi_S$, called "shunt flux", flowing through the flux-diverter 26, the frame 20 and the first flange 22, and a second flux $\phi_U$, called "polarization flux", flowing through the extension 28, the first axial air gap (d), the moving armature 16, the second radial air gap (j1), the sleeve 46, the second flange 24 and returning to the permanent magnet 14 via the frame 20 and the first flange 22. The armature 16 is maintained by magnetic attraction in the retracted position by the polarization flux $\phi_U$ flowing through the first air gap (d), the corresponding magnetic attraction force of the magnet 14 being greater than the bias of the compression spring 36.

When the trip coil 30 is excited by means of a trip signal applied to the terminals of the conductors 52, 54, the magnetic flux $\phi_C$ of the coil 30 opposes in the axial air gap (d) the polarization flux $\phi_U$ of the permanent magnet 14, and weakens the attraction force of the armature 16. When the bias of the return spring 36 becomes preponderant, the armature 16 is forced upwards, to the released position in which the striker 18 causes unlocking of the mechanism. The path of the coil flux $\phi_C$ (see FIG. 1) in the magnetic circuit 12 is through the armature 16, the magnetic flux-diverter 26, the frame 20, the second flange 24 and the sleeve 46, the coil flux $\phi_C$ opposing the polarization flux $\phi_U$ in all the parts of the magnetic circuit 12 except in the flux-diverter 26 which remains saturated.

The coaxial arrangement of the tubular sleeve 46 around the armature 16 determines a large cross-section leading to minimum reluctance of the magnetic circuit 12. In the retracted position, the ferromagnetic sleeve 46 overlaps the armature 16 axially over a predetermined distance, whose length L is greater than the thickness (11) of the second flange 24 and than that (12) of the frame 20. The low reluctance of the magnetic circuit 12 due to the presence of the tubular sleeve 46 requires a coil flux $\phi_C$ of low value enabling the sensitivity of the relay 10 to be increased, and the tripping energy of the coil 30 to be decreased.

Figure 3:
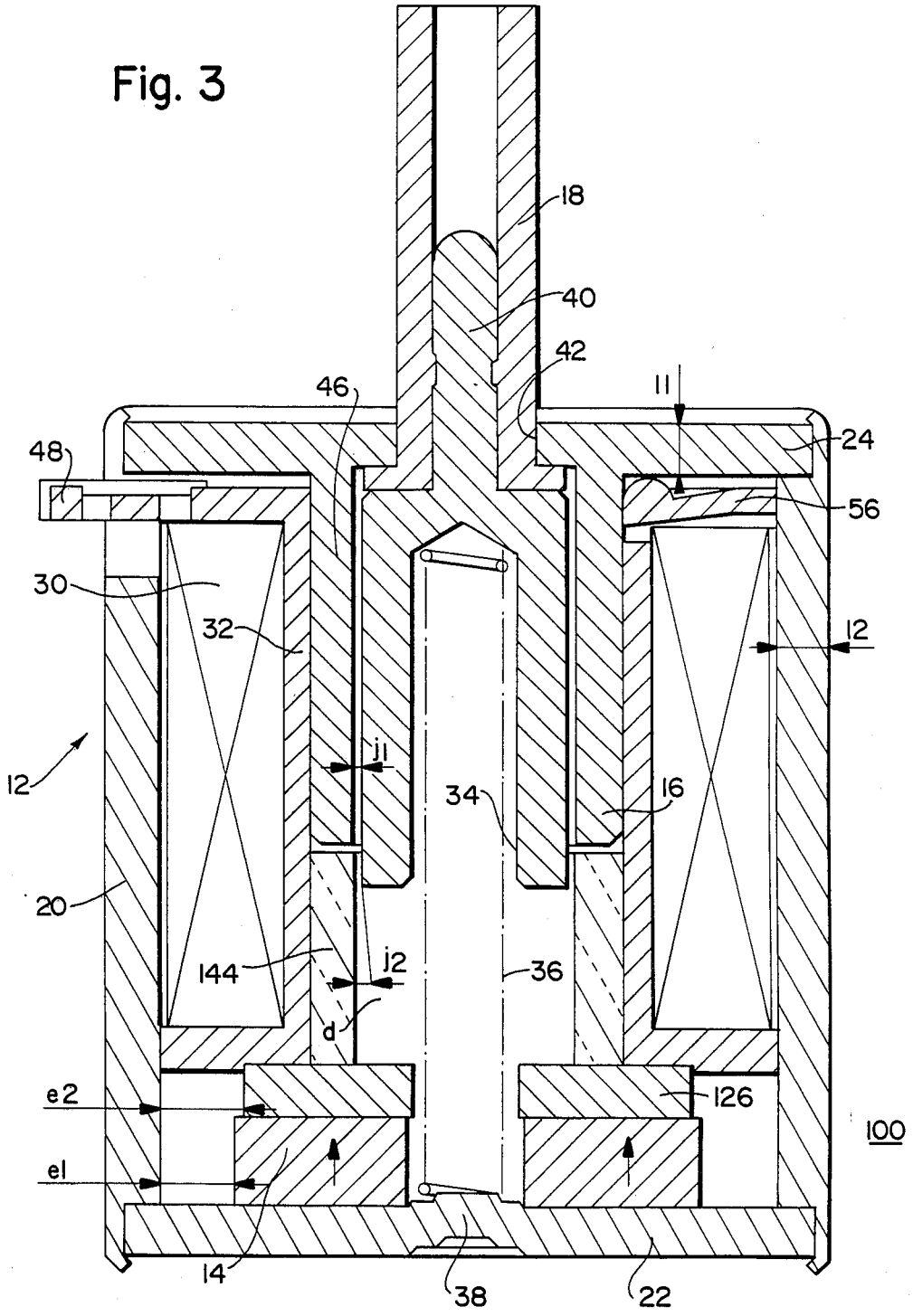
FIG. 3 shows an identical view to that of FIG. 1 of an alternative embodiment, the relay being represented in the tripping position.

In the alternative embodiment of the relay 100 in FIG. 3, the axial translation guiding means of the moving armature 16 comprise a non-magnetic bush 144, notably made of brass, mounted coaxially inside the bushing 32 and interposed between the sleeve 46 and the flux-diverter 126. The radial clearance (j2) between the bush 144 and the armature 16 remains less than the radial air gap (j1) between the sleeve 46 and the armature 16. The flux-diverter 126 is radially separated from the lateral surface of the frame 20 by a gap (e2) which is greater than the thickness (12) of the frame 20, and than the radial distance (e1) between the permanent magnet 14 and the frame 20. All the other parts of the relay 100 are the same as those in FIG. 1 and are assigned the same reference numbers.

The coaxial overlap of the armature 16 by the sleeve 46 enabling the magnetic reluctance to be decreased can be seen from the devices in FIGS. 1 and 3. The dimensions of the flux-diverter 26, 126 and of the permanent magnet 14 in relation to the other parts of the magnetic circuit 12 can naturally be modified according to the sensitivity required from the relay 10.

We claim:

1. Polarized electromagnetic relay with magnetic latching, notably of a trip device for an electric circuit breaker, comprising :

a fixed magnetic circuit made of ferromagnetic material comprising a tubular frame affixed at its opposite ends to a first and a second parallel flange, extending perpendicularly to the longitudinal axis of the frame, an annular permanent magnet with axial magnetization whose coplanar front surfaces of opposed polarities come into contact respectively with the internal wall of the first flange and one of the faces of a magnetic flux-diverter, a moving armature mounted to slide axially according to the direction of the longitudinal axis between a latched position and a released position, said armature being urged into the released position by a return spring, and in the latched position being pressed against the flux-diverter by the magnetic attraction force of the permanent magnet which is of greater intensity than the bias of the return spring, an actuating member associated with the armature and passing axially through an opening in the second flange, the armature and actuating member assembly forming the moving assembly of the relay, a first axial air gap (d) corresponding to the gap between the flux-diverter and the moving armature, a trip coil coaxially mounted on an insulating bushing inside the frame surrounding the moving armature and extending axially between the flux-diverter and the second flange, excitation of said coil causing in the magnetic circuit a magnetic flux ($\phi_C$) which opposes the polarization flux ($\phi_U$) of the permanent magnet in the first air gap (d), so as to release the armature and enable it to move from the latched position to the released position by means of the return spring, wherein the second flange of the magnetic circuit is fitted with a fixed internal sleeve of tubular shape made of ferro-magnetic material, extending partially in an annular space located coaxially between the bushing and the moving armature, the latter being separated from said sleeve by a second radial air gap (j1) which remains uniform during the translation movement of the armature, and the axial overlap distance (L) of the armature by the sleeve in the latched position of the relay is greater than the thickness (11) of the second flange and/or than that (12) of the frame.

2. Electromagnetic relay according to claim 1, wherein the guiding means of the moving assembly in axial translation determine a predetermined radial clearance (j2) with the moving armature, the thickness of said clearance (j2) being smaller than that of the second radial air gap (j1) between the sleeve and the armature.

3. Electromagnetic relay according to claim 2, wherein the guiding means of the armature in translation comprise an annular ledge cast with the coil insulating bushing, and said sleeve extends axially to within proximity of said ledge.

4. Electromagnetic relay according to claim 2, wherein the guiding means in translation are fitted with a non-magnetic bush, interposed axially beween the sleeve and the flux-diverter.

5. Electromagnetic relay according to claim 1, wherein the flux-diverter can be saturated, and extends radially in a direction parallel to the first flange to come into contact with the internal lateral surface of the frame, the thickness of said flux-diverter in its narrowest part being smaller than the thickness of the permanent magnet and/or than that of the frame.

6. Electromagnetic relay according to claim 1, wherein the return spring is of the compression type, and the armature has an axial hole closed at one end to house a part of said spring, the latter passing through the annular flux-diverter and permanent magnet, its opposite end bearing on a central boss of the first flange.

7. Electromagnetic relay according to claim 6, wherein a curved-shaped flexible strip is interposed between one of the front faces of the coil and the second flange to automatically take up any axial play when the various parts which constitute the relay are assembled, and said flexible strip is cast directly with the insulating bushing of the coil.

8. Electromagnetic relay according to claim 6, wherein the bushing comprises a radial lug which protrudes through a notch in the frame to serve the purpose both of preventing rotation of the coil, and of supporting the wires connecting the coil.

9. Electromagnetic relay according to claim 1 wherein the external radius of the annular permanent magnet is greater than its thickness, the latter corresponding to the axial distance separating the first flange and the flux-diverter, and the axial length taken up by the coil is at least greater than half the total length of the relay.

10. Electromagnetic relay according to claim 1, wherein the flux-diverter is radially separated from the frame by a gap (e2) which is greater than the thickness (12) of the frame.

* * * * *